US008727186B2

(12) United States Patent
Wing et al.

(10) Patent No.: US 8,727,186 B2
(45) Date of Patent: May 20, 2014

(54) METHOD AND PRODUCT DELIVERY MECHANISM WITH A PUMP

(75) Inventors: Harry Edward Wing, Midland, MI (US); Donald Earl Hale, Jr., Sanford, MI (US)

(73) Assignee: The Delfield Company, LLC, Mt. Pleasant, MI (US)

( * ) Notice: Subject to any disclaimer, the term of this patent is extended or adjusted under 35 U.S.C. 154(b) by 0 days.

(21) Appl. No.: 13/531,178

(22) Filed: Jun. 22, 2012

(65) Prior Publication Data

US 2013/0160859 A1 Jun. 27, 2013

Related U.S. Application Data

(60) Provisional application No. 61/500,954, filed on Jun. 24, 2011.

(51) Int. Cl.

| | |
|---|---|
| ***B65D 83/00*** | (2006.01) |
| ***B67D 1/04*** | (2006.01) |
| ***F04B 53/06*** | (2006.01) |
| ***F04B 47/04*** | (2006.01) |

(52) U.S. Cl.

CPC . *B67D 1/04* (2013.01); *F04B 53/06* (2013.01); *F04B 47/04* (2013.01)

USPC ..... 222/399; 222/401; 417/395

(58) Field of Classification Search

CPC ..... B67D 1/04; F04B 53/06; F04B 47/04

USPC ..... 222/334, 399, 397, 401, 129, 222/129.1–129.4, 394, 396, 400.8, 400.5, 222/400.7; 417/390–398

See application file for complete search history.

(56) References Cited

U.S. PATENT DOCUMENTS

| | | | | |
|---|---|---|---|---|
| 4,551,076 | A * | 11/1985 | DuBois | 417/395 |
| 4,681,518 | A * | 7/1987 | Credle, Jr. | 417/395 |
| 5,000,351 | A | 3/1991 | Rudick | |
| 5,083,906 | A * | 1/1992 | Du | 417/395 |
| 5,611,937 | A * | 3/1997 | Jarocki | 210/754 |
| 5,869,000 | A | 2/1999 | Decato | |
| 7,918,367 | B2 | 4/2011 | O'Donnell | |
| 2006/0231574 | A1* | 10/2006 | Bilskie et al. | 222/129.1 |
| 2010/0139493 | A1 | 6/2010 | Nevarez | |
| 2011/0049182 | A1* | 3/2011 | Smith et al. | 222/61 |

OTHER PUBLICATIONS

International Search Report dated Sep. 12, 2012 for PCT application No. PCT/US2012/043822.

Written Opinion dated Sep. 12, 2012 for PCT application No. PCT/US2012/043822.

International Preliminary Report on Patentability (IPRP) dated Jul. 2, 2013 from corresponding PCT/US2012/043822, pp. 12.

* cited by examiner

*Primary Examiner* — Lien Ngo

(74) *Attorney, Agent, or Firm* — Ohlandt, Greeley, Ruggiero and Perle, L.L.P.

(57) ABSTRACT

A product delivery mechanism for a beverage dispensing system that dispenses flavor/ingredients and ice into a serving cup for mixing and/or blending. The product delivery system includes a gas operated pump for moving the flavor/ingredients from a product source to a dispensing nozzle above the serving cup. A gas restrictor is connected to an exhaust port of the pump to regulate gas flow rate and product flow rate so as to prevent splashing at the cup while operating the pump well within its rated pressure limits.

10 Claims, 4 Drawing Sheets

METHOD AND PRODUCT DELIVERY MECHANISM WITH A PUMP

RELATED APPLICATION

This application claims the benefit of U.S. Provisional Application No. 61/500,954, filed Jun. 24, 2011, the entire contents of which are incorporated herein by reference.

BACKGROUND OF THE INVENTION

1. Field of the Invention

The present disclosure relates generally to a method and a product delivery mechanism that moves a product from a product source to an output device and to a pump.

2. Description of Related Art

Some beverage dispensing machines use pumps to produce a flow rate for an ingredient that can damage or decrease the life span of valves that dispense the ingredient to a mixing container, which results in splashing around the dispense area. Pump manufacturers suggest that the product flow rate can be decreased by restricting the product conduit or decreasing operating pressure to the pump. Due to the various viscosities of ingredients, restricting the product input line to the pump would require multiple restrictors, which would increase the chance of clogging. A decrease in power source pressure too near the lower pressure limit of manufacturer specifications does not eliminate the splashing. If the gas flow rate to an inlet of the pump is decreased, there are pressure drops that makes ingredient flow rates inconsistent.

Thus, there is a need for a method and product delivery mechanism that overcomes the aforementioned disadvantages of the known beverage dispensing systems.

SUMMARY OF THE DISCLOSURE

In one embodiment of the present disclosure, the product delivery mechanism comprises a conduit that provides a gas and a pump that is interconnected with the product source and the conduit and that is powered by the gas to deliver the product to the output device. A gas restrictor alters a flow rate of the gas through an exhaust port of the pump and a flow rate of the product to the output device.

In another embodiment of the product delivery mechanism of the present disclosure, the gas restrictor comprises an elongated shape with a bore having a diameter significantly smaller than a diameter of the exhaust port.

In another embodiment of the product delivery mechanism of the present disclosure, the bore is a first bore, and the gas restrictor comprises a second bore with a diameter larger than the diameter of the first bore so as to decrease a chance of the gas restrictor clogging up.

In another embodiment of the product delivery mechanism of the present disclosure, the conduit is connected to a gas source.

In another embodiment of the product delivery mechanism of the present disclosure, the output device comprises a beverage dispensing nozzle.

In one embodiment of the method according to the present disclosure, the method comprises supplying gas via a conduit, connecting a pump to the product source, the output device and the conduit and limiting a flow rate of the gas at an exhaust port of the pump and a flow rate of the product to the output device.

In another embodiment of the method of the present disclosure, the flow rate is limited by a gas restrictor connected to the exhaust port.

In another embodiment of the method of the present disclosure, the gas restrictor comprises an elongated shape with a bore having a diameter significantly smaller than a diameter of the exhaust port.

In another embodiment of the method of the present disclosure, the bore is a first bore, and the gas restrictor comprises a second bore with a diameter larger than the diameter of the first bore so as to decrease a chance of the gas restrictor clogging up.

In another embodiment of the method of the present disclosure, the conduit is connected to a gas source.

In another embodiment of the method of the present disclosure, the output device comprises a beverage dispensing nozzle.

BRIEF DESCRIPTION OF THE DRAWINGS

Other and further objects, advantages and features of the present disclosure will be understood by reference to the following specification in conjunction with the accompanying drawings, in which like reference characters denote like elements of structure.

DETAILED DESCRIPTION OF THE DISCLOSURE

The product delivery mechanism of the present disclosure can be used in any apparatus that requires delivery of a liquid product to an output device. However, by way of example and completeness of description, the product delivery mechanism is shown herein as embodied in a beverage dispensing assembly.

Figure 1:
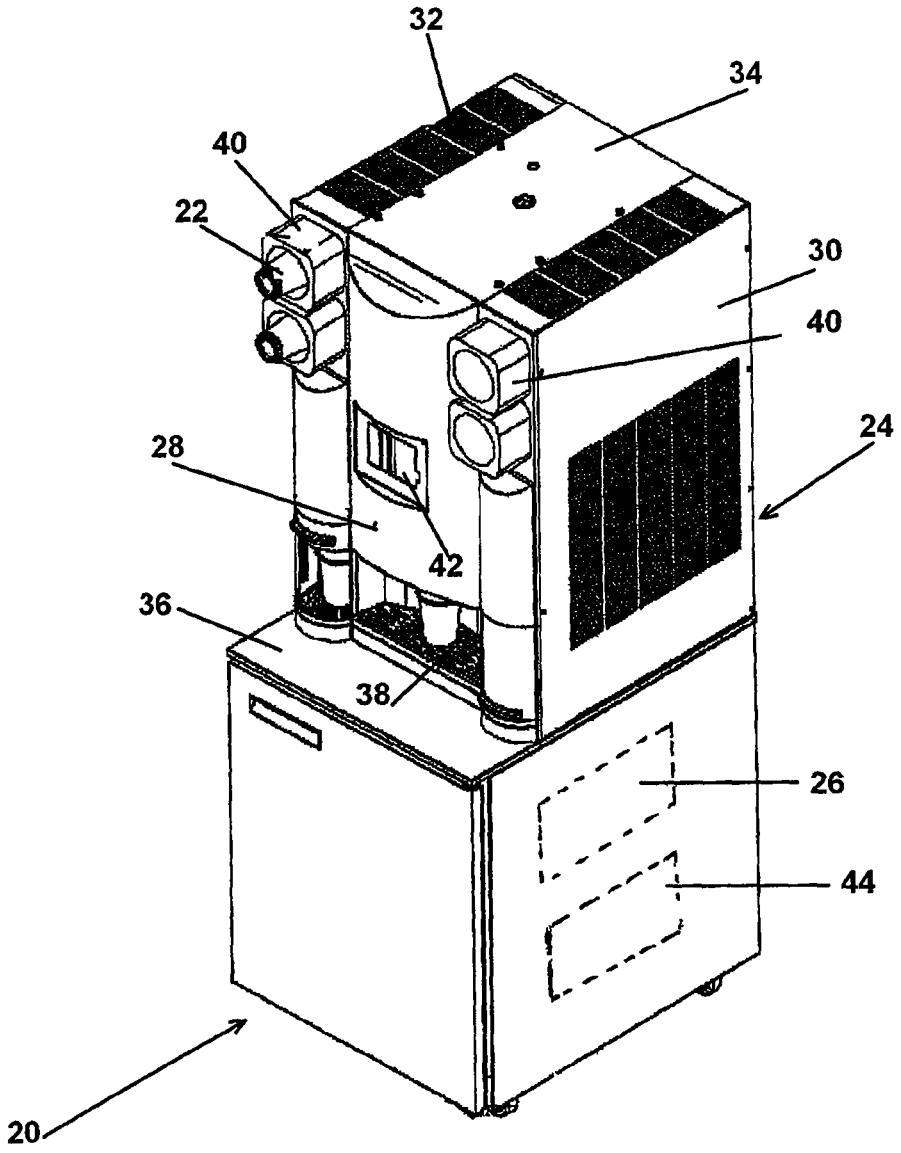
FIG. 1 is a perspective view of an exemplary beverage dispensing machine in which the product delivery mechanism of the present disclosure is embodied.

Referring to FIG. 1, an exemplary beverage dispensing assembly 20 makes ice, dispenses flavors/ingredients and ice into a serving cup 22, and then blends or mixes them to form a beverage. One such beverage, for example, is a smoothie that preferably includes a flavor ingredient and ice mixed together. Beverage dispensing assembly 20 has a housing 24 that houses an onboard ice maker (not shown), an ice storage and portion control module (not shown), a flavor/ingredient dispensing module 26, and a blender/mixer/cleaning module (not shown).

Housing 24 includes an upper wall 28, side walls 30 and 32, a top wall 34 and a lower wall 36. Lower wall 36 has a container holder portion 38. A pair of cup holders 40 is mounted on upper wall 28. Cup holders 40 removably hold cups 22 therein. Cup 22 may be disposable or reusable single serving cups. If cup 22 is disposable, such as, for example, paper or plastic cups, the beverage dispensed and mixed within cup 22 may be served directly to a customer eliminating the step of pouring the beverage into a serving cup and eliminating labor needed to wash an additional container. Cup 22 may be any size, such as, for example, about 10 ounces to about 32 ounces. A control panel 42 is located on upper wall 28 and is used by a user to select a flavor ingredient and to initiate delivery of the flavor ingredient to cup 22. A controller or control circuitry 44 responds to user operation of control panel 42 to control assembly 20 to make beverages. Though shown in lower wall 36 section, control circuitry 44 may be located in one or more other locations of beverage dispensing assembly 20.

Figure 2:
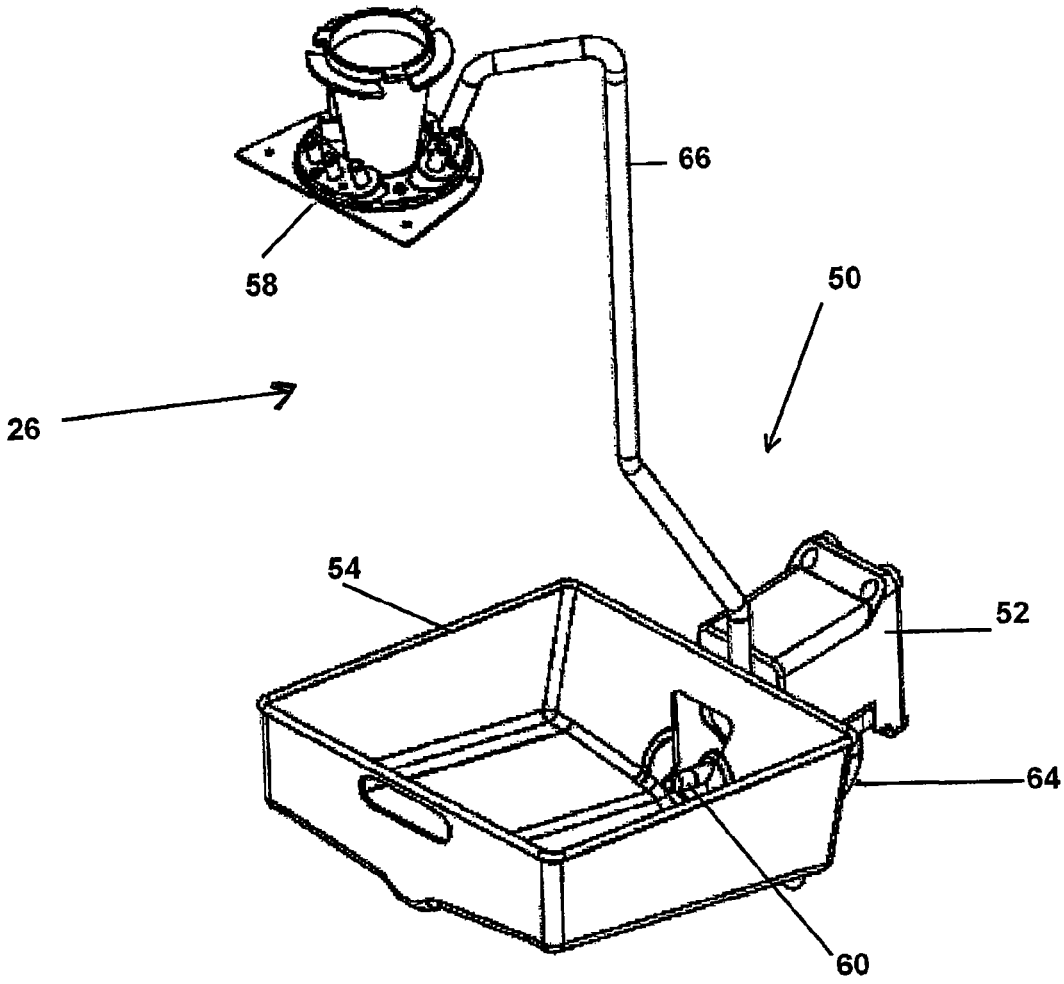
FIG. 2 is a perspective view of the product delivery mechanism of the present disclosure.
Figure 3:
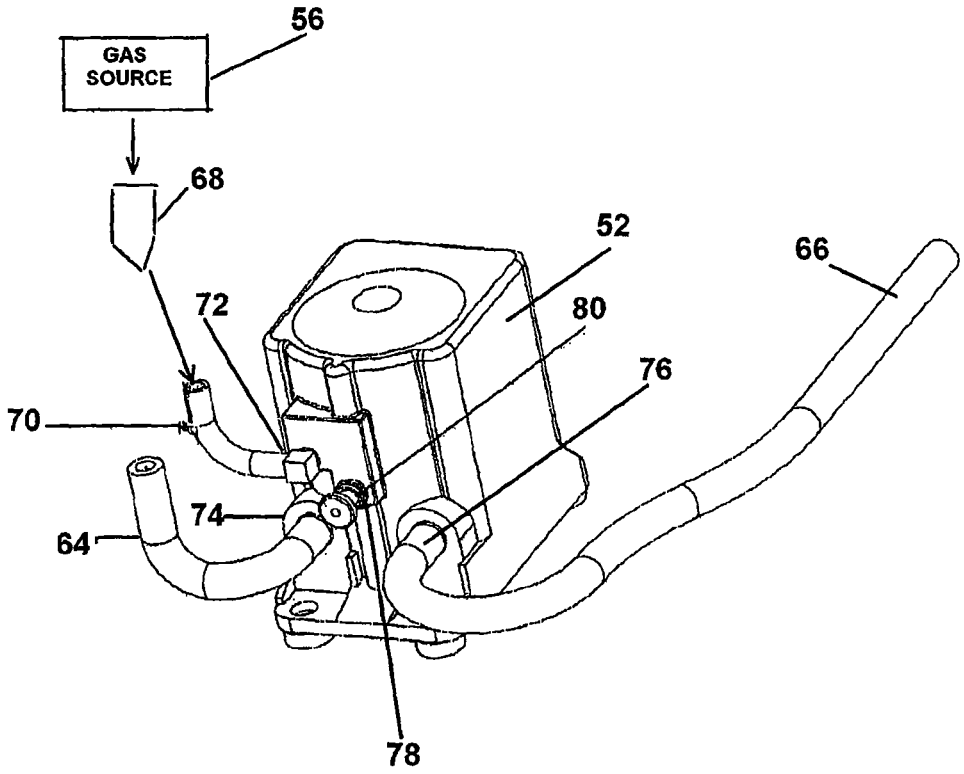
FIG. 3 is a perspective view of the pump of the product delivery mechanism of FIG. 2.

Referring to FIGS. 2 and 3, flavor/ingredient dispensing module 26 comprises a product delivery mechanism 50 of the present disclosure. Product delivery mechanism 50 comprises a pump 52, a product source 54, a gas source 56 (shown in FIG. 3) and an output device 58. Product source 54 holds a liquid product, which for the beverage dispensing assembly embodiment is a flavor ingredient, for example, strawberry, mango and others. Alternately, product source 54 may comprise a holder that holds a flexible container that in turn holds the liquid product. Output device 58 is a beverage dispensing nozzle device for the beverage dispensing assembly embodiment. Pump 52 for the beverage dispensing assembly embodiment is a gas powered diaphragm pump. Gas source 56 provides a gas, for example, air or carbon dioxide under sufficient pressure to pump the flavor ingredient from product source 54 to output device 58.

Product source 54 is connected to a connection tube 60 so that the ingredient flows out of product source 54 and through connection tube 60. Connection tube 60 is connected to a conduit 64, which is connected to pump 52. Pump 52 moves a portion of the ingredient from product source 54 through connection tube 60, conduit 64, and a line conduit 66 to output device or beverage dispensing nozzle 58 to dispense the ingredient to cup 22.

Gas source 56 is connected via a solenoid valve 68 and a conduit 70 to a gas input port 72 of pump 52. Conduit 64 is connected to a product input port 74 of pump 52. Conduit 66 is connected to a product output port 76. In beverage dispensing assembly 20 there may be a product delivery mechanism 26 for each of several flavor ingredients. The output device or beverage dispensing nozzle 58 then includes a nozzle for each of the flavor ingredients. The user selects a flavor via control panel 42. Controller 44 operates the solenoid valve 68 associated with the product delivery mechanism 50 for the selected flavor ingredient to be pumped to output device 58.

A gas exhaust port 78 of pump 52 is fastened to a gas restrictor 80. In some known pumps an exhaust muffler is connected to exhaust port 78. For these pumps, gas restrictor 80 replaces the exhaust muffler. The fitting of gas restrictor 80 has a significantly smaller inside diameter than the diameter of the gas muffler or of gas exhaust port 78. For example, in one embodiment the inside diameter of gas restrictor 80 is about 0.031 inch, which is about 5% of the inside diameter of gas exhaust port 78. For this example, the inside diameter of gas exhaust port 78 is approximately 0.119 inch. This allows pump 52 to operate at a gas pressure that is well within the manufacture specified pressure limits while restricting gas flow rate from gas source 56.

Gas restrictor 80 restricts the flow rate of gas at gas exhaust port 78, which in turn restricts or decreases the rate at which pump 54 pumps product. In one embodiment, the product flow rate with gas restrictor 80 is about one ounce per second vis-à-vis two ounces per second with the gas muffler.

Figure 4:
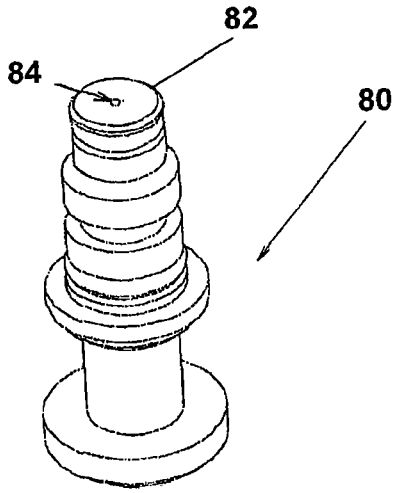
FIG. 4 is a perspective view of the gas restrictor of the pump of FIG. 3.
Figure 5:
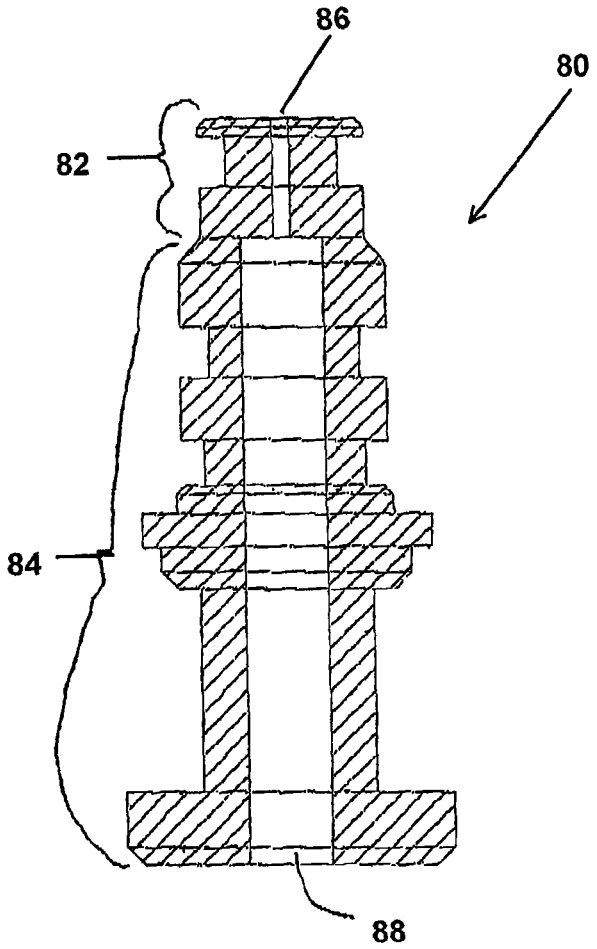
FIG. 5 is an exploded cross sectional view of FIG. 4.

Referring to FIGS. 4 and 5, gas restrictor 80 has an elongated shape that is preferably cylindrical and comprises sections 82 and 84. Section 82 that mates with gas exhaust port 78 has a bore 86 with the significantly reduced diameter. Section 84 has a bore 88 that has a much larger diameter, which decreases the chance of gas restrictor 80 clogging or freezing up.

Controller 44 initiates the making of a beverage when the user has selected one or more flavor ingredients and has placed a cup 22 in container holder portion 38. That is, controller 44 opens solenoid valve 68 to connect gas source 56 to gas input port 72 of pump 52. Controller 44 can control the amount of ingredient pumped by regulating the time that solenoid valve 68 is open.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A product delivery mechanism for moving a product from a product source to an output device comprising:

a conduit that provides a gas; and a pump that is interconnected with said product source and said conduit and that is powered by said gas to deliver said product to said output device; and a gas restrictor that is fastened to an exhaust port of said pump and that alters a flow rate of said gas through an exhaust port of said pump and a flow rate of said product to said output device.

2. The product delivery mechanism of claim 1, wherein said gas restrictor comprises an elongated shape with a bore having a diameter significantly smaller than a diameter of said exhaust port.

3. A product delivery mechanism, for moving a product from a product source to an output device comprising:

a conduit that provides a gas; and a pump that is interconnected with said product source and said conduit and that is powered by said gas to deliver said product to said output device; and a gas restrictor that is fastened to an exhaust port of said pump and that alters a flow rate of said gas through said exhaust port of said pump and a flow rate of said product to said output device, wherein said gas restrictor comprises an elongated shape with a bore having a diameter significantly smaller than a diameter of said exhaust port, and wherein said bore is a first bore, and wherein gas restrictor comprises a second bore with a diameter larger than said diameter of said first bore so as to decrease a chance of said gas restrictor clogging up.

4. The product delivery mechanism of claim 1, wherein said conduit is connected to a gas source.

5. The product delivery mechanism of claim 1, wherein said output device comprises a beverage dispensing nozzle.

6. A method of moving product from a product source to an output device comprising:

supplying gas via a conduit;

connecting a pump to said product source, said output device and said conduit; and with a gas restrictor fastened to an exhaust port of said pump, limiting a flow rate of said gas at an exhaust port of said pump and a flow rate of said product to said output device.

7. The method of claim 6, wherein said gas restrictor comprises an elongated shape with a bore having a diameter significantly smaller than a diameter of said exhaust port.

8. A method of moving product from a product source to an output device comprising:

supplying gas via a conduit;

connecting a pump to said product source, said output device and said conduit; and with a gas restrictor fastened to an exhaust port of said pump, limiting a flow rate of said gas at said exhaust port of said pump and a flow rate of said product to said output device, wherein said gas restrictor comprises an elongated shape with a bore having a diameter significantly smaller than a diameter of said exhaust port, and wherein said bore is a first bore, and wherein said gas restrictor comprises a second bore with a diameter larger than said diameter of said first bore so as to decrease a chance of said gas restrictor clogging up.

9. The method of claim 6, wherein said conduit is connected to a gas source.

10. The method of claim 6, wherein said output device comprises a beverage dispensing nozzle.

* * * * *